US006131000A

United States Patent [19]

Akatsu et al.

[11] Patent Number: 6,131,000

[45] Date of Patent: Oct. 10, 2000

[54] ELECTROPHOTOGRAPHIC PRINTING APPARATUS USING ELECTRIC POTENTIAL DIVIDING DEVELOPMENT

[75] Inventors: Shinichi Akatsu; Teruaki Mitsuya, both of Naka-machi; Kenichi Ito; Nobuyoshi Hoshi, both of Hitachinaka; Ryuuichi Shimizu, Hitachioota; Hisao Okada, Hitachi; Hiroyuki Mabuchi, Hitachinaka; Masayoshi Ishii, Mito; Seiji Maruo, Chitose, all of Japan

[73] Assignees: Hitachi, Ltd.; Hitachi Koki Co., Ltd., both of Tokyo, Japan

[21] Appl. No.: 09/208,447

[22] Filed: Dec. 10, 1998

[30] Foreign Application Priority Data

Dec. 15, 1997 [JP] Japan ..... 9-344616
Dec. 15, 1997 [JP] Japan ..... 9-344617

[51] Int. Cl.[7] ..... G03G 15/00

[52] U.S. Cl. ..... 399/51; 399/55

[58] Field of Search ..... 399/51, 53, 54, 399/55, 178, 184, 194, 198, 223, 231, 232; 347/115, 131, 129, 132, 112, 225; 430/363

[56] References Cited

U.S. PATENT DOCUMENTS 5,817,447 10/1998 Yip ..... 430/363
5,832,333 11/1998 Umeda et al. ..... 399/48
5,869,214 2/1999 Anzai et al. ..... 399/47
5,884,119 3/1999 Maruo et al. ..... 399/51

FOREIGN PATENT DOCUMENTS 48-37148 6/1973 Japan .

*Primary Examiner*—Quana Grainger
*Attorney, Agent, or Firm*—Antonelli, Terry, Stout & Kraus, LLP

[57] ABSTRACT

An electrophotographic printing apparatus using electric potential dividing development processing without the occurrence of primary fringe and fringe caused by auxiliary exposure has reverse electric fields causing primary fringe and fringe caused by auxiliary exposure adjusted to be nearly equal to each other. The auxiliary exposure is applied to an area surrounding one image, and an electric potential of an intermediate electric potential zone is brought close to a bias electric potential of another image which is not subjected to auxiliary exposure. Further, a white portion to produce a reverse electric potential therein at the rear end of an electric potential portion to be developed with toner, relative to a rotating direction of a developing roller, is exposed with a light intensity forming an electric potential between an electric potential developing an image with toner and the intermediate electric potential, and portions at the front end and the sides are exposed with a light intensity forming the intermediate electric potential.

6 Claims, 13 Drawing Sheets

RESISTIVITY OF DEVELOPING AGENT — AMOUNT OF REPULSIVE FRINGE

RESISTIVITY OF DEVELOPING AGENT —REVERSE ELECTRIC FIELD

ELECTRIC POTENTIAL ON SURFACE OF PHOTOSENSITVE BODY

ELECTRIC POTENTIAL ON SURFACE OF PHOTOSENSITVE BODY qEz AND FR ON SURFACE OF PHOTOSENSITVE BODY qEz AND FR ON SURFACE OF PHOTOSENSITVE BODY

FRINGE IMAGE

ELECTROPHOTOGRAPHIC PRINTING APPARATUS USING ELECTRIC POTENTIAL DIVIDING DEVELOPMENT

BACKGROUND OF THE INVENTION

The present invention relates to a printing apparatus of the electrophotographic type for developing an image using colored particles like toner, such as a printer, a facsimile, a copier and the like; and, more particularly, the invention relates to an electrophotographic printing apparatus using a developing method in a developing process for forming a toner image on a surface of a printing medium.

A conventional developing method and developing unit will be described below. A printing apparatus of the electrophotographic type uses a developing process for forming a colored particle image on a surface of a medium and a fixing process for fixing the colored particle image onto the medium. Powder called toner for electrophotography is used for the colored particles.

In the developing process, initially the colored toner particles are charged using a developing agent. The developing agent is a mixed powder of toner and carrier beads of magnetic particles. The developing agent is contained in a developing unit and mixed therein. The toner is charged by friction with the beads generated at that time. In image forming in the developing process, a method called bias development is commonly used. A photosensitive body is first charged over the whole surface thereof, and then the charge is selectively discharged by irradiating light thereon. Therein, an electric potential pattern (electrostatic latent image) is formed on the surface of the photosensitive body consisting of charged zones and discharged zones.

In the bias development, a bias voltage is applied to a magnet roller called a developing roller, which transfers developing agent up to a position opposite a developing position where an electrostatic latent image is carried on the surface of the photosensitive body. By doing so, the charged toner particles are separated from the developing agent on the surface of the developing roller and are transferred to the surface of the photosensitive roller by the action of an electric field generated between an electric potential of the latent image formed on the surface of the photosensitive body and the developing roller. Thus, a toner image is formed.

The difference between the bias voltage of the developing roller and the electric potential of a latent electrostatic image formed on the photosensitive body is referred to as a developing electric potential difference. There is no need to say that, when the developing electric potential difference is large, the formed electric field (called developing electric field) becomes strong and, accordingly, the developing performance is improved. A method involving the narrowing of the distance between the developing roller and the photosensitive body, or a method which calls for decreasing the electric resistivity of the developing agent also has the same effect of strengthening the developing electric field and improving the developing performance.

A modified version of the electrophotography bias developing described above is proposed in, for example, Japanese Patent application Laid-Open No.48-37148. In this developing method, development using two kinds of toner is carried out with one charging process and one irradiating process (exposing process) by providing an intermediate electric potential zone, by dividing an electric potential between a charged zone and a discharged zone on a photosensitive body, and by developing the discharged zone with a first toner using a first developing unit for performing reverse development of the discharged zones, and then developing the charged zone using a second toner with a second developing unit for performing normal development of the charged zones.

In this developing method, the toner is not attached in the intermediate electric potential zone on the photosensitive body having a voltage value between the bias voltage value of the first reverse developing unit and the bias voltage value of the second normal developing unit, and, in this way, a background portion is formed as an image. Therefore, it is possible to form an image composed of a background portion, a first image portion and a second image portion using two kinds of toner. In this specification, this developing method will be referred to as a method of the electric potential dividing development type. In general, the two kinds of toner used are classified by color, and are used to obtain an image composed of two colors. Further, in principle, the electric potential dividing development method can be performed by setting the first development to a normal developing and the second development to a reverse developing.

In the bias development, when an electrostatic latent image is formed on a photosensitive body, an electric field emphasizing the development is produced at an end portion of the latent image, and at the same time an electric field having a polarity opposite to the polarity of the latent image (a reverse electric field) is generated at the periphery of the latent image. In the case of bias development, which uses one kind of toner and employs the electric potential dividing developing method, this reverse electric field is not a problem in forming an image.

However, in the electric potential dividing development process in which positive and negative electrostatic latent images are formed on the photosensitive body and two kinds of toner (hereinafter, taking red toner and black toner as an example), charged in polarities respectively opposite to the polarities of the images, are developed, there occurs a fringe development in which red toner attaches around a black image and black toner attaches around a red image due to the attraction of the reverse electric fields. The fringe development represents an erroneous printing in that toner is attached at an unexpected position.

Characteristics of the fringe development will be described below with reference to FIGS. 10A to 10C. FIG. 10A is a diagram showing forces acting on toner on a surface of a photosensitive body. The toner attached to a leading end portion of a spike formed by the developing agent is moved toward the photosensitive body from the developing roller by an electric field force qEz, which is expressed by the product of an electric field Ez in an opposite direction due to an edge effect in the surrounding area of an image portion and a charge amount q of the toner.

The peripheral speed of the surface of the developing roller is generally set to be faster than the peripheral speed of the surface of the photosensitive body in order to improve the developing performance. In the illustrated example, the photosensitive body and the developing roller are rotated in the same direction, and a friction force FR by the spikes of the developing agent acts on the toner in the positive Y-direction caused by the difference between the peripheral speeds of the surfaces of the photosensitive body and the developing roller.

In addition to the electric field force qEz and the friction force FR, a force qEy in a direction along the surface of the photosensitive body at a peripheral portion of the image portion caused by a difference between the electric potential of the image portion and the electric potential of a white portion at the periphery thereof acts on the toner. If the image is at an electric potential of the discharged zone, the electric field Ey is generated so as to be directed outward from the peripheral portion of the image. If the image is at an electric potential of the charged zone, the electric field Ey is generated so as to be directed inward from the peripheral portion of the image.

The toner development by the electric field in the opposite direction due to the edge effect at the periphery of the discharged electric potential zone has a certain amount of positive charge, and the toner developing by the electric field in the opposite direction due to the edge effect at the periphery of the charged electric potential zone has a certain amount of negative charge. Therefore, the electric field force qEy acts on the toner in a direction outward from the peripheral portion of the image in both cases. In the present specification, the electric field in the opposite direction is referred to as a reverse electric field.

FIG. 10B is a view showing forces in the direction along the surface of the photosensitive body which act on the toner at the front end and the rear end of the image relative to the rotating direction of the developing roller. The directional relationship between the friction force FR and the electric field force qEz is different between the front end and the rear end of the image. At the front end of the image, the friction force FR and the electric field force qEz act in the same direction, and the toner developing the fringe is scraped off from the edge portion of the image. On the other hand, at the front end of the image, the friction force FR and the electric field force qEz act in directions opposite to each other, and the toner developing the fringe is retained at the edge portion of the image.

FIG. 10C is a view showing a feature of the fringes which occur at the front end side and the rear end of the image, in respect to the rotating direction of the developing roller, which are produced by the above-mentioned forces acting on the toner on the surface of the photosensitive body. A stronger fringe development appears at the rear end of the image than at the front end thereof. If the intensity of the fringes is suppressed to a certain degree by the resistivity of the developing agent and the developing bias using the difference in the characteristics of fringe intensity between the front end and the rear end of the image, what remains is only the fringe at the rear end of the image, which has the stronger intensity.

In order to eliminate erroneous printing caused by fringe development, it can be considered that an electric potential dividing developing method without fringe development can be realized by introducing exposure control (hereinafter, referred to as fringe control) in which an expected position of occurrence of fringe development is predicted and an auxiliary exposure is applied to the expected position to suppress the occurrence of a reverse electric field.

When the above-mentioned method is employed, it is required to supply a different exposure amount of light to each of the fringe around a red image and the fringe around a black image as an auxiliary exposure, and drivers are respectively required corresponding to the set exposure amounts when an analog light emitting element driver cannot be used. Further, when a fringe control means is used, there is a problem in that a reverse electric field generated by the auxiliary exposure light causes additional fringe-like erroneous printing. In this specification, the fringe-like erroneous printing caused by auxiliary exposure of light is referred to as a fringe caused by auxiliary exposure.

The conventional electric potential dividing development method described above fails to give consideration to fringe development, and fails to give sufficient consideration to a condition and method for preventing occurrence of a fringe caused by auxiliary exposure. Therefore, the conventional electric potential dividing development method has a problem in that a fringe caused by auxiliary exposure is substantially generated under a condition of a large peripheral effect of an electric field, such as when employing a high resistivity developing agent.

Further, in a case of employing fringe control, the size of the control circuit is not taken into consideration. When an analog light emitting element driver cannot be used in order to supply a different exposure amount of light to each of a fringe around a red image and a fringe around a black image in providing the auxiliary exposure, there is a problem in that individual drivers are required corresponding to each of the set exposure amounts, respectively.

SUMMARY OF THE INVENTION

An object of the present invention is to prevent the occurrence of a fringe caused by auxiliary exposure and to provide an electrophotographic printing apparatus which can satisfy a developing condition capable of preventing the occurrence of a fringe caused by auxiliary exposure.

Another object of the present invention is to provide an electrophotographic printing apparatus using electric potential dividing development processing, without producing a fringe and without fringe development caused by auxiliary exposure, by employing an appropriate auxiliary exposing method.

A further object of the present invention is to provide a simple and small-sized electrophotographic printing apparatus which is capable of suppressing the occurrence of fringe development using the difference in the characteristics of fringe occurrence intensity between the front end and the rear end of an image.

In order to achieve the above objects, in accordance with the present invention, the reverse electric fields causing the production of a primary fringe and a fringe caused by auxiliary exposure are set to be nearly equal to each other. Further, auxiliary exposure light according to fringe control technology is added to one side of the area surrounding an image, so that the electric potential of an intermediate electric potential zone is brought close to a bias electric potential of the image on the side at which the auxiliary exposure light has not been added and is moved away from a bias electric potential of the other image. Furthermore, auxiliary exposure light is spatially switched on and off within a preset range in a terminal end portion of the auxiliary exposure range to generate the fringe caused by the auxiliary exposure.

The present invention is characterized by an electrophotographic printing apparatus using an electric potential dividing development method, which forms zones having at least three different electric potential levels composed of a charged zone, an intermediate zone and a discharged zone on a photosensitive body using an exposing unit, which develops the charged zone and the discharged zone using different kinds of particles, respectively, and which uses a fringe control means, wherein the light intensity of the auxiliary exposure is set so that the degrees of a primary fringe and a fringe caused by auxiliary exposure become nearly equal to each other when the primary fringe and the fringe caused by auxiliary exposure are generated by adjusting the developing bias.

Further, an electrophotographic printing apparatus using an electric potential dividing development method, which forms zones having at least three different electric potential levels, composed of a charged zone, an intermediate zone and a discharged zone, on a photosensitive body using an exposing unit, which develops the charged zone and the discharged zone using different kinds of colored particles, respectively, and which uses a fringe control means, wherein an auxiliary exposure is applied to a zone adjacent to one electric potential zone of a charged zone and a discharged zone and the auxiliary exposure is not applied to a zone adjacent to the other electric potential zone.

Furthermore, an electrophotographic printing apparatus using an electric potential dividing development method, comprises at least a photosensitive body; a first charging unit; an exposing unit; a developing unit; and a transfer unit, forming zones having at least three different electric potential levels on the photosensitive body using the exposing unit, developing zones having at least two electric potential levels out of the zones having at least three different electric potential levels using different kinds of particles, respectively, which comprises a fringe control means for preventing fringe development using auxiliary exposure, the auxiliary exposure being controlled so as to be switched on and off within a preset range in a terminal end portion of the auxiliary exposure range.

When the fringe control means is used, it is necessary to judge white portions in the whole periphery of an image generating a reverse electric field and to expose the white portions with an amount of light other than a weak exposure and a strong exposure. Therefore, a circuit for judging an auxiliary exposure position and a driver circuit for causing an exposing element to emit light in an auxiliary exposure amount are required.

Further, by providing a means for determining a position of occurrence of the fringe, it is possible to provide a simple and small-sized fringe control circuit.

In accordance with the present invention, during exposure after charging the photosensitive body, the photosensitive body is exposed with amounts of light so as to form three electric potential portions, including a charged zone to be normally developed with toner, a discharged zone to be reversely developed with toner and an intermediate electric potential zone to be not developed with toner. In addition, the amount of light forming an electric potential between the electric potential developing the image with a toner and an intermediate electric potential is exposed on a white portion on which a reverse electric potential is to be produced, located at a position at the rear end of an electric potential portion to be developed in an image with toner thereon, relative to the rotating direction of the developing roller, and the amount of light forming an intermediate electric potential is exposed on white portions on which a reverse electric potential is to be produced at the front end and on the sides.

It is preferable that the electrophotographic printing apparatus further comprises a memory operating as the means for determining the zone of the white portion located at the position on the rear end of the portion charged at the electric potential to be developed as a solid image with toner thereon, relative to the rotating direction of the developing roller. The memory is used for storing classification information indicating which data is past data by one line relative to image data about to be printed now, image data of a charged electric potential portion, or image data of a discharged electric potential portion, or image data for performing printing at an electric potential between the electric potential developing the solid image with toner and the intermediate electric potential. By doing so, it is possible to provide a simpler and smaller-sized fringe control circuit.

The electrophotographic printing apparatus in accordance with the present invention, as described above, includes not only the use of two kinds of toners which are different in color, but also includes the use of toners of the same color, but which are different in other characteristics. For example, two black toners may be used, with one being non-magnetic and the other magnetic. This case is employed when it is required to add magnetic information in a part of an image.

DESCRIPTION OF THE PREFERRED EMBODIMENTS

An embodiment of the present invention will be described below with reference to FIG. 1 to FIG. 5.

Figure 1:
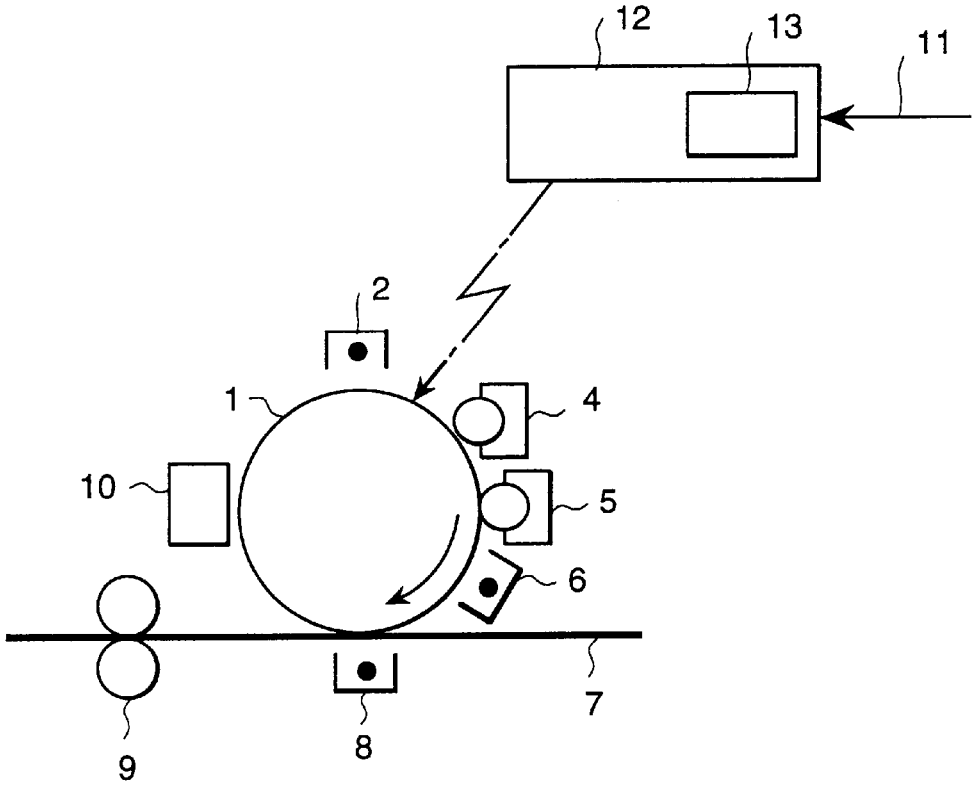
FIG. 1 is a schematic side view showing a first embodiment of a two-color laser printer using an electric potential dividing development method.

FIG. 1 is a schematic view showing a two-color laser printer using an electric potential dividing development method. The laser printer includes a photosensitive drum 1, a charger 2, a first developing unit 4, a second developing unit 5, a pre-transfer charger 6, a paper sheet 7, a transfer unit 8, a fixing unit 9, a cleaner 10, and an exposure unit 12 in which there is an auxiliary exposure control means 13.

An electrostatic latent image is formed by the exposure unit 12 on a surface of the photosensitive drum 1, which has been charged uniformly by the charger 2. After that, the electrostatic latent image is developed using electric potential dividing development processing with two color toners by the two developing units 4, 5. Since the charge polarities of the two toners are different, the pre-transfer charger 6 is used for unifying the polarities of the color toners.

The two color toners unified in polarity by the pre-transfer unit 6 are transferred to a paper sheet 7 by the transfer unit 8. After that, the transferred two color toner image is heated and melted by the fixing unit 9 so as to be fixed onto the paper sheet 7. Further, the toner which is not transferred and remains on the surface of the photosensitive drum 1 is collected by the cleaner 10, and thus the series of processes are completed. Therein, the auxiliary exposure is performed according to the input image signal 11 by which the auxiliary exposing control means 13 in the exposure unit 12 is operated.

Figure 2:
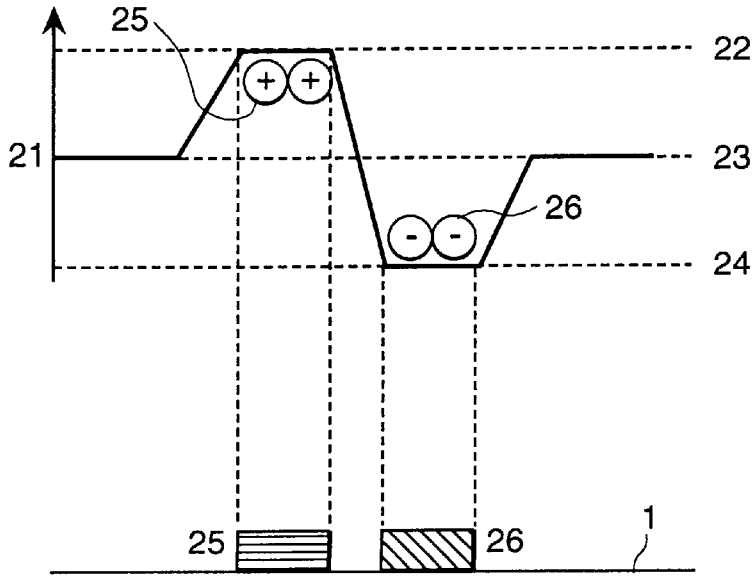
FIG. 2 is a diagram showing the relationship between electric potential distribution on a surface of a photosensitive body and the developed image in an electric potential dividing development process.

FIG. 2 is a diagram showing the relationship between the electric potential distribution on the surface of a photosensitive body and a developed image in the electric potential dividing development process. The reference character 21 denotes the ordinate indicating the electric potential on the surface of the photosensitive body. The reference character 22 denotes the electric potential of a charged zone (Vo), the reference character 23 denotes the electric potential of an intermediate discharged zone (Vw), the reference character 24 denotes the electric potential of a completely discharged zone (Vr), the reference character 25 denotes positive charged toner and the reference character 26 denotes negative charged toner.

By controlling the amount of exposure in two steps to control the electric potentials on the surface of the photosensitive body 21 to three levels of Vo, Vw and Vr, an unexposed portion (charged zone electric potential (Vo) 22) to be normally developed with the positively charged toner 25, a strongly exposed portion (completely discharged zone electric potential (Vr) 24) to be reversely developed with the negatively charged toner 26 and a weakly exposed portion (intermediate discharged zone electric potential (Vw) 23) to be not developed with either of the toners so as to provide a white image zone are formed.

Figure 3A:
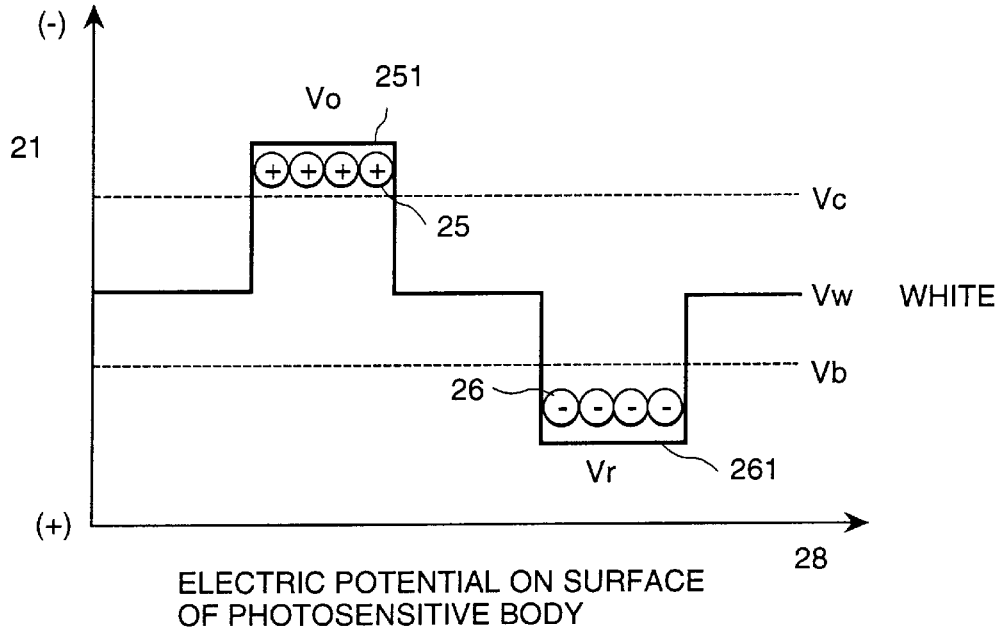
FIGS. 3A and 3B are diagrams showing a distribution of electric potential and a distribution of electric field, respectively, on a surface of a photosensitive body after exposure.
Figure 3B:
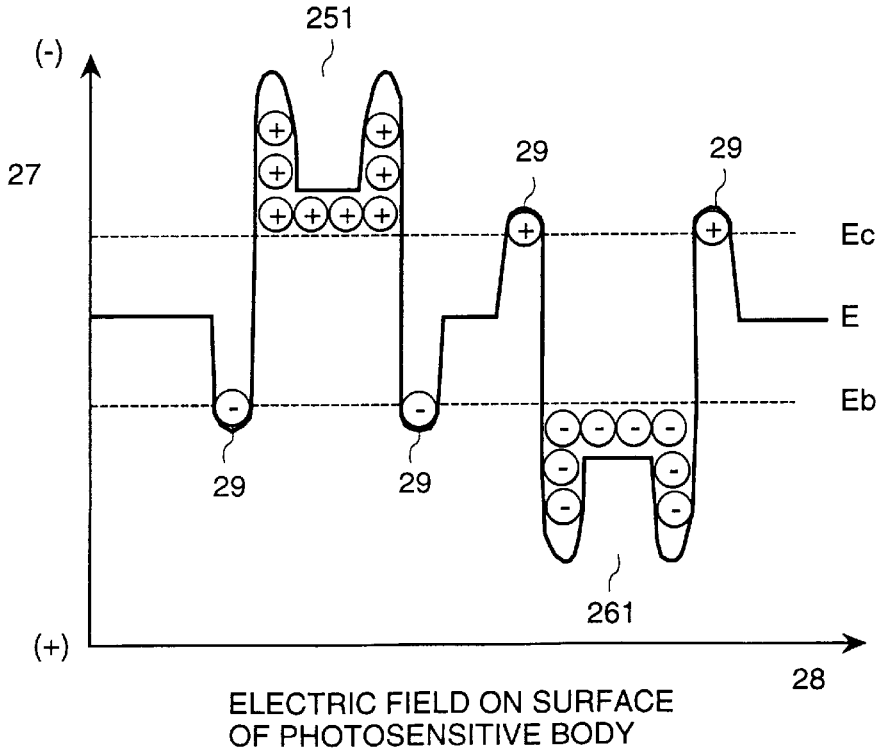

The development of fringe will be described below. FIG. 3A and FIG. 3B are diagrams showing the distribution of electric potential and the distribution of electric field, respectively, on a surface of a photosensitive body after exposure. The reference character 27 denotes the ordinate and indicates the electric potential or the electric field, respectively. The reference character 28 denotes the abscissa and indicates a position of the photosensitive body surface. The reference character 29 denotes a fringe, the reference character 251 denotes an image zone to be normally developed, and the reference character 261 denotes an image zone to be reversely developed.

The reference character E denotes an electric field on the surface of the photosensitive body 1 on the basis of a certain hypothetical electric potential existing at a position other than the photosensitive body 1 and the developing units 4, 5, and the reference characters Ec, Eb denotes electric fields on the surface of the developing units 4, 5 corresponding to developing bias voltages Vc, Vb on the basis of the same hypothetical electric potential as that of E, respectively.

FIG. 3A shows an example of an exposure for forming an unexposed portion (an image zone to be normally developed), a strongly exposed portion (an image zone to be reversely developed) and a weakly exposed portion (a white image zone). From the viewpoint of the electric potential, there seems to be no problem in that the surface electric potentials are normally and reversely developed with developing biases Vc and Vb, respectively. However, the development is actually performed by an electric field which is obtained by spatially differentiating the distribution of the electric potential. FIG. 3B is a diagram showing the electric field corresponding to FIG. 3A.

The electric fields Ec, Eb change in proportion to changes in the electric potentials Vc, Vb. It can be understood from FIG. 3B that electric field enhanced zones are produced at the end portions of the image zones, that is, at positions corresponding to the positions where the electric potential changes. In a case where development is performed using only one kind of toner among the bias developments, the electric field enhancement in the edge portion appears only as an enhancement (increasing) of the image density in the edge portion because either the reverse or the normal development is solely performed.

However, in the electric potential dividing development process, the surrounding portion of a desired image is sometimes developed with an opposite kind of toner by a reverse electric field produced in a white image zone. This development is called a fringe development. It can be understood from FIG. 3B that a fringe 29 is produced at a position where the electric field E around the image zone 251 to be normally developed exceeds the electric field Ec.

Therefore, the fringe around the reversely developed image can be decreased by increasing the absolute value of the bias Vc because the absolute value of Ec is increased. On the other hand, the fringe around the normally developed image can be decreased by decreasing the absolute value of the bias Vb because the absolute value of Eb is decreased.

Figure 4:
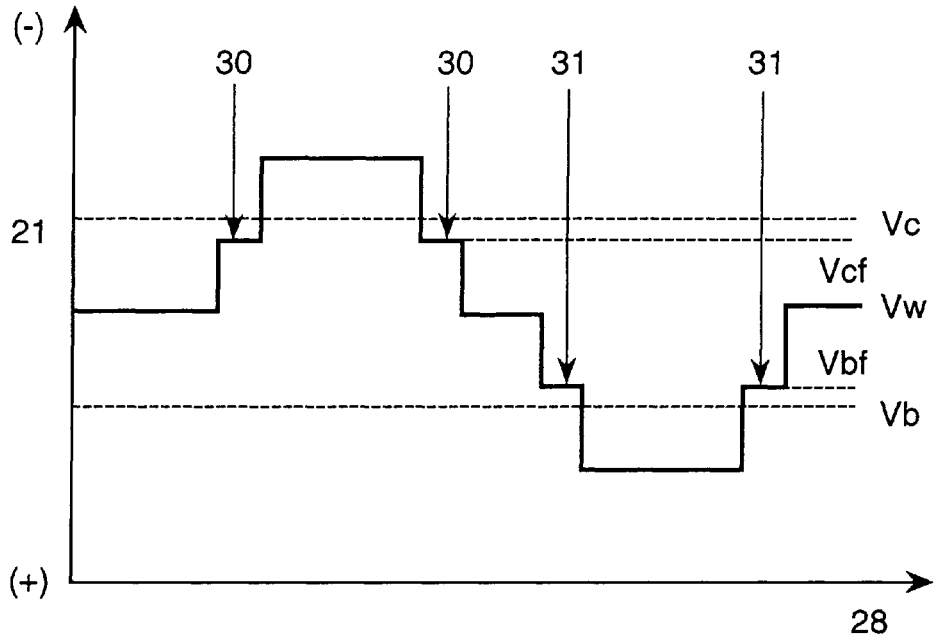
FIG. 4 is a diagram showing an example of the distribution of an electric field on a surface of a photosensitive body when exposure control is performed.

FIG. 4 is a diagram showing an example of the distribution of an electric field on a surface of a photosensitive body when exposure control is performed. The figure shows a case where the exposure control is performed on both of the images of the normally and reversely developed zones. The reference character 30 denotes an auxiliary exposure of the normally developed zone, and the reference character 31 denotes an auxiliary exposure of the reversely developed zone. The purpose of the exposure control is to moderate the electric field intensity (gradient of electric field) around an image by exposure. In detail, the electric potential around the image is controlled so as to be formed in a step shape by the exposure, as shown in FIG. 4. By doing so, the electric field generated around the image is weakened so as to suppress the occurrence of fringe development.

Figure 5:
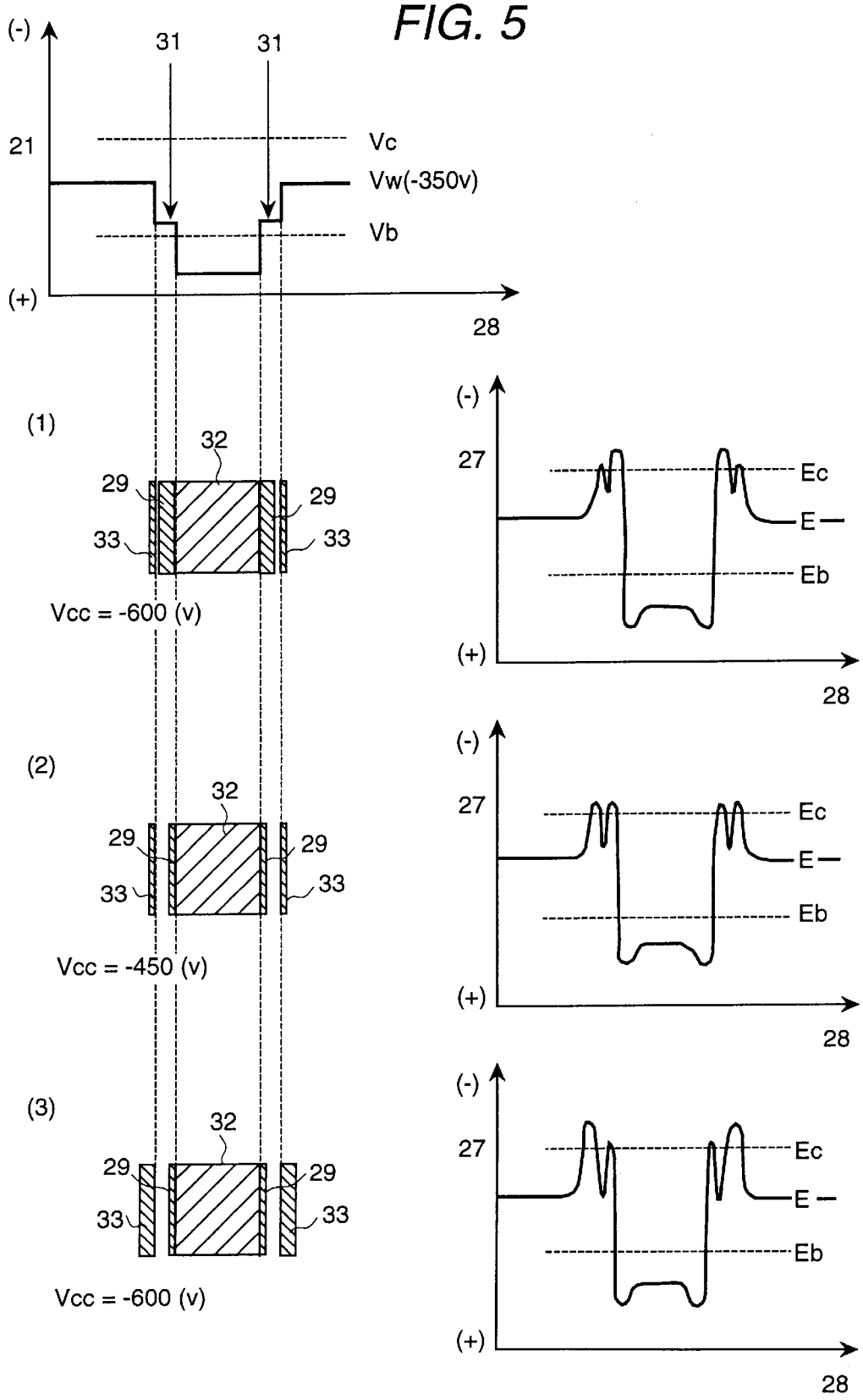
FIG. 5 is a diagram showing an output image, when fringe is generated by performing exposure control, and the corresponding distribution of an electric field.

FIG. 5 is a diagram showing output images (1), (2), (3) and corresponding distributions of electric field when exposure control is performed, so that fringe caused by normal toner is generated, taking a reverse development as an example. An example of the electric potential distribution in this case is also illustrated adjacent the output images (1), (2), (3). The reference character 32 denotes the reversely developed image, and the reference character 33 denotes the fringe caused by auxiliary exposure.

The output image (1) is an image produced in a case where the auxiliary exposure 31 is irradiated by decreasing its light intensity, the output image (3) is an image produced in a case where the auxiliary exposure 31 is irradiated by increasing its light intensity, and the output image (2) is an image produced in a case where the auxiliary exposure 31 is irradiated with a light intensity between the intensities for the output image (1) and the output image (3). The reference character Vcc indicates a voltage at which both the primary fringe 29 and the fringe caused by auxiliary exposure 33 are eliminated when the absolute value of bias voltage Vc is increased. The voltage Vcc can be decreased when the auxiliary exposure 31 is appropriately performed as in the case of the output image (2).

The reason for this is that the peak values of the reverse electric fields in the primary fringe and the fringe caused by auxiliary exposure become nearly equal to each other, and consequently the two peak values themselves become small. In the cases of the output image (1) and the output image (2), one of the reverse electric fields of the primary fringe and the fringe caused by auxiliary exposure is low, but the other becomes high. That is, either the size of the primary fringe or the size of the fringe caused by auxiliary exposure becomes large.

Therefore, the absolute value of Vcc can be decreased by adjusting both the primary fringe 29 and the fringe caused by auxiliary exposure 33 they will to become nearly equal to each other, and accordingly the primary fringe can be suppressed and at the same time the fringe caused by auxiliary exposure can be suppressed. The primary fringe 29 and the fringe caused by auxiliary exposure 33 are actively produced by decreasing the absolute value of Vc (in a case of surrounding of a normal image, by increasing the absolute value of Vb), and the degrees of the primary fringe 29 and the fringe caused by auxiliary exposure 33 may be evaluated as to width, the reflecting density, the color difference, the amount of attached toner or products of these values.

Another embodiment of the present invention will be described below, referring to FIG. 5 and FIG. 6.

A higher peak height of the electric field between the primary fringe and the fringe caused by auxiliary exposure is called a fringe peak electric field. It can be understood from FIG. 5, as described in the embodiment 1, that since the fringe peak electric field is decreased to a minimum value under a condition that both the primary fringe 29 and the fringe caused by auxiliary exposure 33 become nearly equal to each other, the difference between Ec and the fringe peak electric field can be increased.

On the contrary, when the fringe peak electric field is brought close to Ec by increasing Vw to make the electric potential distribution between the normal side and the reverse side unbalanced, the difference between Eb and the fringe peak electric field can be increased. In the present specification, this is called an unbalanced electric potential distribution. FIG. 6 is a diagram showing a distribution of the electric field under an unbalanced electric potential distribution.

Figure 6:
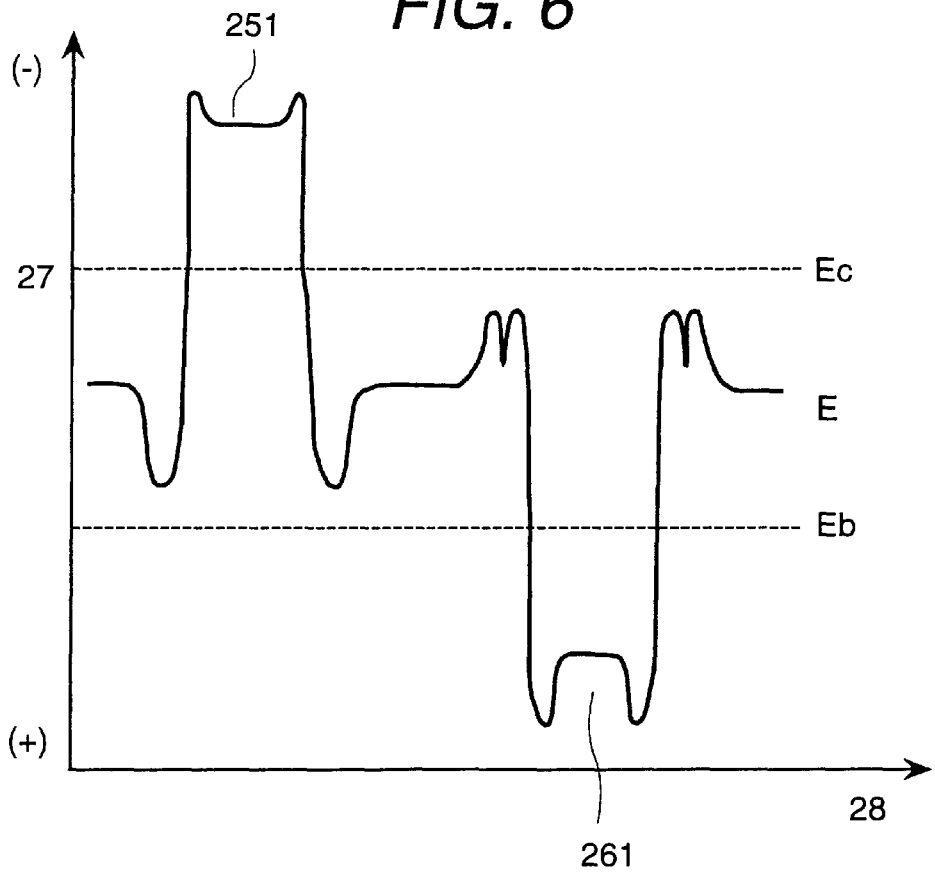
FIG. 6 is a diagram showing the distribution of an electric field under an unbalanced electric potential distribution.

In FIG. 6, auxiliary exposure is performed so that the fringe 29 around the reversely developed image zone 261 is eliminated by bringing the fringe peak electric field close to Ec by increasing Vw. By adding the auxiliary exposure to the fringe around the reverse image to increase Vw so as to bring the fringe peak electric field close to Ec and to increase the difference between Eb and the fringe peak electric field around the normally developed image, the occurrence of fringe can be prevented without performing auxiliary exposure around the normal image. On the contrary, by selecting the opposite unbalanced electric potential distribution, the occurrence of fringe can be prevented without performing auxiliary exposure around the reverse image by adding the auxiliary exposure to the fringe around the normal image.

As described above, according to the present embodiment, the circuit scale of the auxiliary exposure unit can be reduced since it is sufficient to irradiate the auxiliary exposure light only around either the normal image or the reverse image. Therein, even in a case where the method of adjusting both the primary fringe and the fringe caused by auxiliary exposure to be equal to each other, as described in the embodiment 1, is not employed together, by employing the unbalanced electric potential distribution, it is possible to irradiate the auxiliary exposure light only around either the normal image or the reverse image, as in the present embodiment.

Figure 7A:
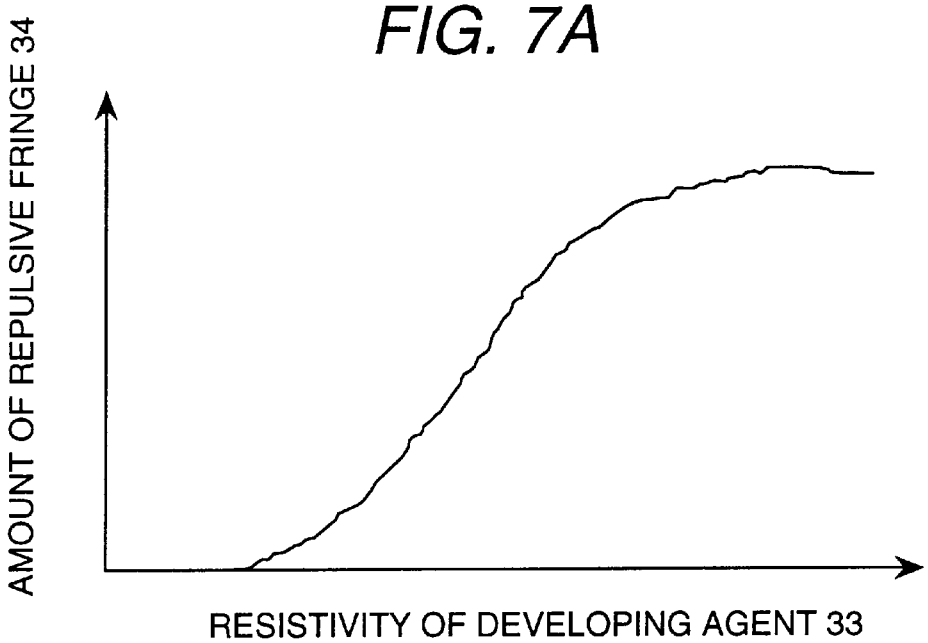
FIGS. 7A and 7B are graphs explaining the conflicting relationship between electric resistivity of a developing agent, fringe caused by auxiliary exposure and the electric field on a surface of a photosensitive body.
Figure 7B:
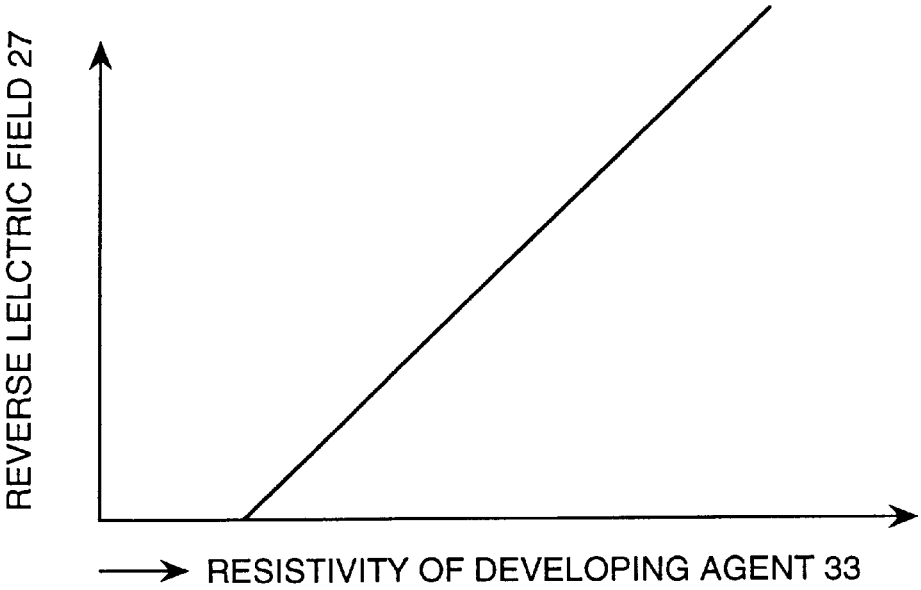

FIG. 7A and FIG. 7B are diagrams showing the relationship between the resistivity of a developing agent and the degree of occurrence of fringe caused by auxiliary exposure, and the relationship between resistivity of the developing agent and the electric field on a photosensitive body surface. The reference character 33 denotes the abscissa which indicates the electric resistivity (hereinafter referred to as resistivity) of developing agent. The reference character 34 denotes the ordinate which indicates the degree of occurrence of fringe caused by auxiliary exposure. The reference character 27 denotes the ordinate which indicates the intensity of the reverse electric field, which is a factor in the occurrence of fringe caused by auxiliary exposure in a terminal end portion of an auxiliary exposure range. As the resistivity of the developing agent is increased, the distribution of the electric field on the photosensitive body surface is enhanced in the reverse electric field produced in a white image zone so as to increase the degree of occurrence of fringe caused by auxiliary exposure.

Further, even in a case where the auxiliary exposure is performed with such a light intensity that the degrees of occurrence of the primary fringe and the fringe caused by auxiliary exposure become nearly equal to each other, when the resistivity of the developing agent exceeds a value R, the peak values of the reverse electric field in the primary fringe and the fringe caused by auxiliary exposure become equal to or larger than the electric field in an unexposed portion (a charged portion), and accordingly the voltage Vcc eliminating both the primary fringe and the fringe caused by auxiliary exposure cannot be found even if the bias voltage Vc is increased up to the voltage Vo of the charged zone.

Therefore, by using a developing agent having a resistivity lower than R in the electrophotographic printing apparatus, the occurrence of fringe caused by auxiliary exposure can be suppressed. According to an experiment conducted by the inventors, it was found that the resistivity R satisfying the condition nearly equal to the above-mentioned charged zone is 528E+6 Ωcm. The current flowing in a developing agent was determined by measuring a voltage generated between a developing roller and an electrode under an experimental condition in which the electrode corresponding to a photosensitive drum having a diameter of 66 mm was rotated at a surface peripheral speed of 300 mm/s; a developing roller having a diameter of 40 mm was rotated so that its surface moved in the same direction as that of the electrode at a peripheral speed of 600 mm/s; the gap between the electrode and the developing roller was set to 1.5 mm; the gap between the developing roller and a doctor was set to 1.2 mm; and the length of the developing roller in the shaft direction to which a developing agent is supplied was set to 110 mm. The electric resistivity was calculated by dividing a voltage applied to the developing agent by the obtained current.

From the above result, it has been determined that it is necessary to set the resistivity R of the developing agent above 29E+6 and below 528E+6 Ωcm. However, since the bias Vc becomes nearly equal to Vo if the higher values of resistivity R in this range are employed, a sufficient developing voltage cannot be obtained and the image density becomes low. Therefore, it is preferable that the resistivity R of the developing agent is set below 469E+6 Ωcm. By employing a value within this range, it is possible to obtain an image without any primary fringe and any fringe caused by auxiliary exposure and having a sufficient image density using fringe control. The present embodiment has been described taking the primary fringe and the fringe caused by auxiliary exposure produced around a reverse developed image as an example, and accordingly the description has been directed to the resistivity of the developing agent for normal development. However, the range of the resistivity has the same effect as the resistivity of the developing agent for reverse development.

Figure 8A:
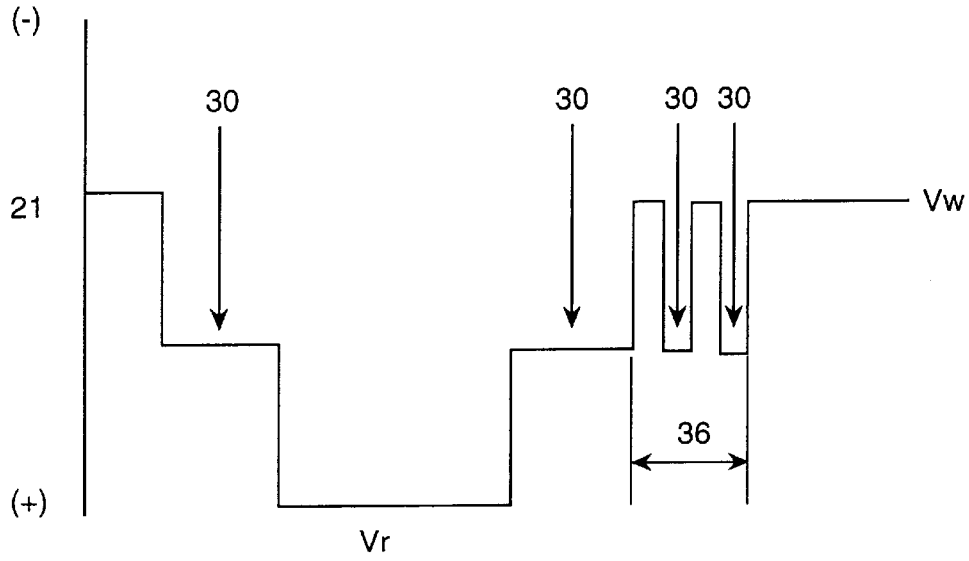
FIGS. 8A and 8B is diagrams showing an example of curtailed exposure control.
Figure 8B:
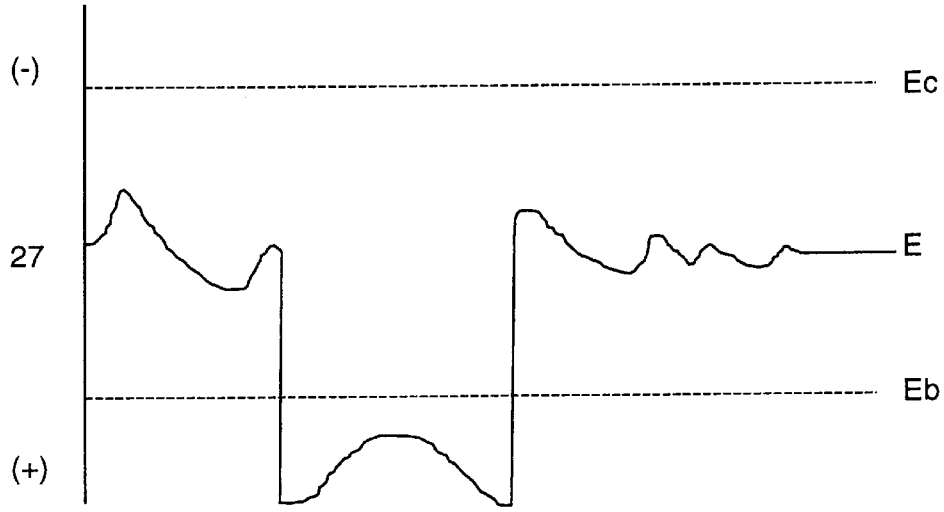

FIG. 8A and FIG. 8B are diagrams showing still another embodiment according to the present invention, which shows an example of the control of the auxiliary exposure (curtailed exposure) in which the auxiliary exposure is switched on and off within a preset range in a terminal end portion of the auxiliary exposure range. The reference character 36 indicates the range of the curtailed exposure range. A reverse electric field caused by the auxiliary exposure is produced in the terminal end portion of the auxiliary exposure range to produce the fringe caused by auxiliary exposure due to a reverse electric field.

The primary fringe and the fringe caused by auxiliary exposure are suppressed at a time by setting the light intensity of the auxiliary exposure so as to make both the primary fringe and the fringe caused by auxiliary exposure nearly equal to each other, and the fringe caused by auxiliary exposure is moderated by performing a curtailed exposure in the terminal end portion of the auxiliary exposure range. The reason for performing the curtailed exposure is that, in order to lower the peak value of the reverse electric field produced by the auxiliary exposure, the intensity of the reverse electric field is weakened by further adding auxiliary exposure light to the reverse electric field.

By repeating this operation, the reverse electric field produced by the auxiliary exposure can be moderated to lower the peak value. As described above, by performing curtailed exposure, the peak value of the reverse electric field in the fringe caused by auxiliary exposure can be lowered and the light intensity of the auxiliary exposure can be increased, and the peak value of the reverse electric field in the primary fringe can be also lowered and the absolute value of Vcc can be further decreased. This effect can be obtained in the case of adding the auxiliary exposure to the surrounding portion of a normal image.

Figure 9:
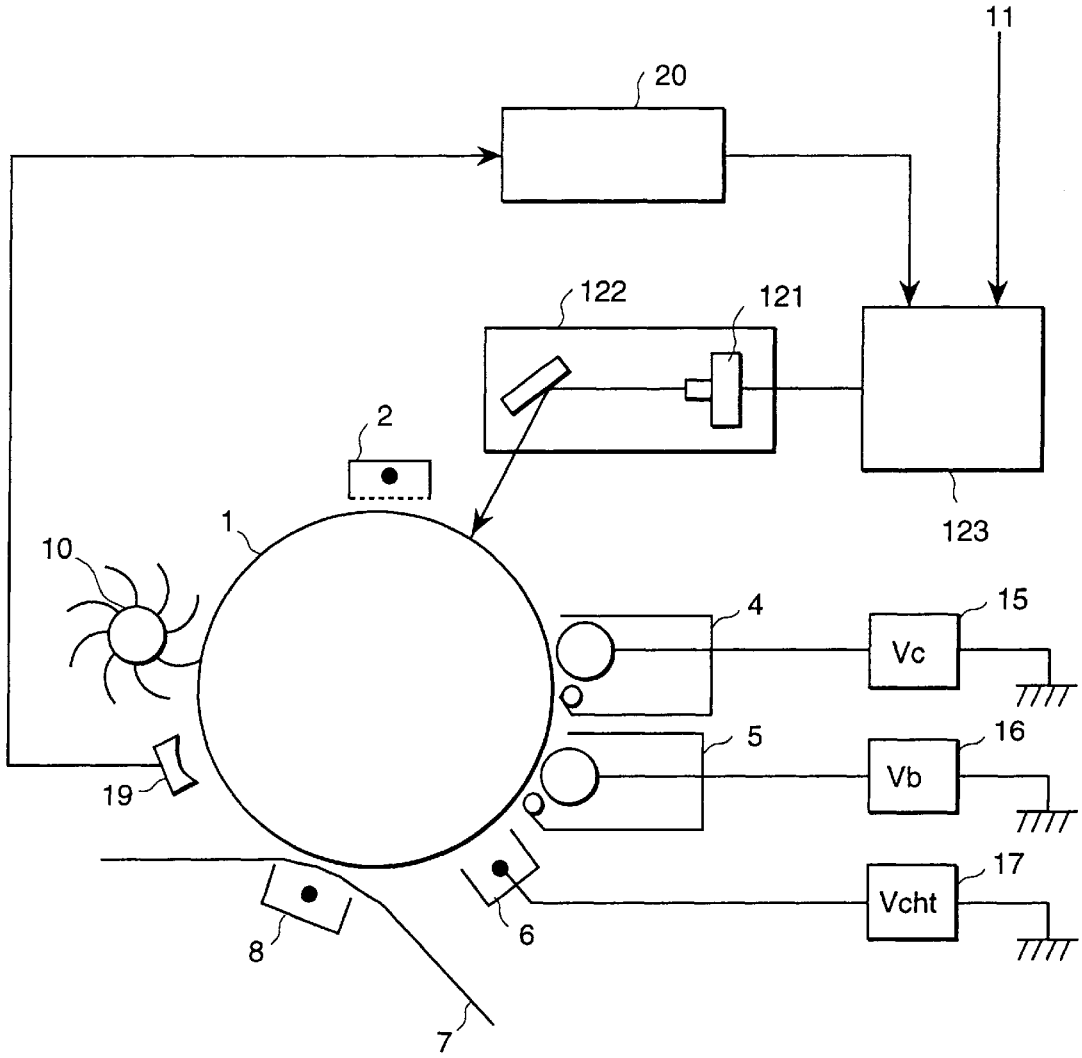
FIG. 9 is a schematic diagram showing the construction of an electrophotographic printing apparatus in accordance with the present invention.

FIG. 9 is a schematic diagram showing the construction of an electrophotographic printing apparatus to which the present invention is applied. Description will be made of a case where in this apparatus, a negative charged OPC is used for a photosensitive drum 1, a positive charged toner is used as a first toner and a negative charged toner is used as a second toner.

In FIG. 9, the photosensitive drum 1 is rotated clockwise, initially the surface of the photosensitive drum 1 is uniformly negatively charged by a charger 2, and an electrostatic latent image, composed of three level surface electric potentials 22, 23, 24, is formed on the photosensitive drum 1 by an exposure unit 122.

In detail, using the reference characters in FIG. 2, the values of the surface electric potentials are about −900 V at the level 22, about −450 V at the level 23 and about −50 V at the level 24. Next, a first image is developed on the photosensitive drum 1 with the positive charged first toner by a first developing unit 4 supplied with a developing bias Vc (−650 V) from a power source 15. Then, a second image is developed on the photosensitive drum 1 with the negative charged second toner by a second developing unit 5 supplied with a developing bias Vb (−250 V) from a power source 16. The development with each of the first toner and the second toner is performed using a two-component developing agent consisting of mixture of toner and carrier as the developing agent.

The two-color toner image composed of the first toner image and the second toner image formed on the photosensitive drum 1 through the above-described procedure is corona irradiated by a charger 6 and the charge polarities are unified to a negative polarity. A high voltage is applied to the charger 6 from a power source 17. When the applied high voltage is positive, the first and the second toners are unified to a positive charge. When the applied high voltage is negative, the first and the second toners are unified to a negative charge.

Which polarity the toners are unified to is determined depending on the transfer polarity, but the polarity is unified to be negative in the apparatus in this embodiment. Then, the two-color image is transferred onto a print medium 7, such as a paper sheet by a transfer unit 8, and is fixed by a fixing unit, not shown in the figure. The photosensitive drum 1, after the transferring of the toner image, is used for the next two-color image forming after any remaining toner is removed by a cleaner 10.

Figure 10A:
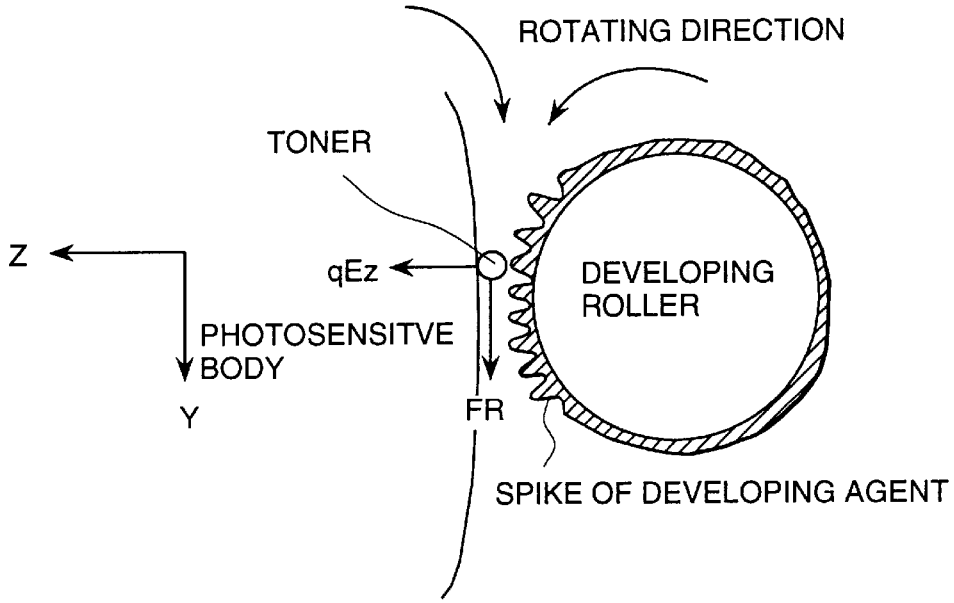
FIGS. 10A to 10C are diagrams showing characteristics of fringe development.

Characteristics of fringe development will be described below with reference to FIGS. 10A to 10C. FIG. 10A is an illustration showing forces acting on toner on a surface of a photosensitive body. The toner which makes up the front end portion of a spike formed of the developing agent is moved toward the photosensitive body from the developing roller by an electric field force qEz, represented by the product of an electric field Ez in an opposite direction due to an edge effect in the surrounding area of an image portion and a charge amount q of the toner.

The peripheral speed of the surface of the developing roller is generally set to be faster than the peripheral speed of the surface of the photosensitive body in order to improve the developing performance. In the illustrated example, the photosensitive body and the developing roller are rotated in the same direction, a friction force FR by the spikes of the developing agent acts on the toner in the positive Y-direction caused by the difference between the peripheral speeds of the surfaces of the photosensitive body and the developing roller.

In addition to the electric field force qEz and the friction force FR, a force qEy in a direction along the surface of the photosensitive body at a peripheral portion of the image portion caused by a difference between the electric potential of the image portion and the electric potential of a white portion in the periphery acts on the toner. If the image is at the discharged electric potential level 24, the electric field Ey is generated so as to be directed outward from the peripheral portion of the image. If the image is at the charged electric potential level 22, the electric field Ey is generated so as to be directed inward from the peripheral portion of the image. The toner development by the electric field in the opposite direction due to the edge effect at the periphery of the discharged electric potential 24 has a certain amount of positive charge, and the toner development by the electric field in the opposite direction due to the edge effect at the periphery of the charged electric potential 22 has a certain amount of negative charge. Therefore, the electric field force qEy acts on the toner in a direction outward from the peripheral portion of the image in both cases.

Figure 10B:
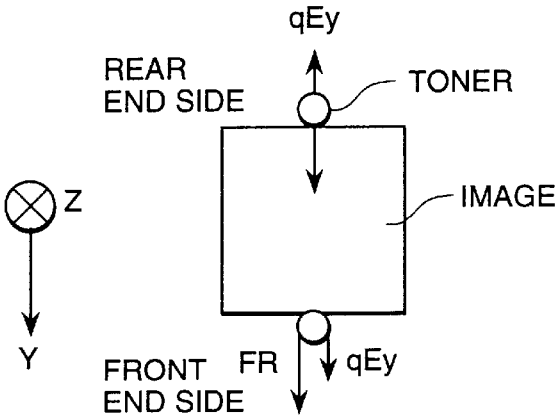
Figure 10C:
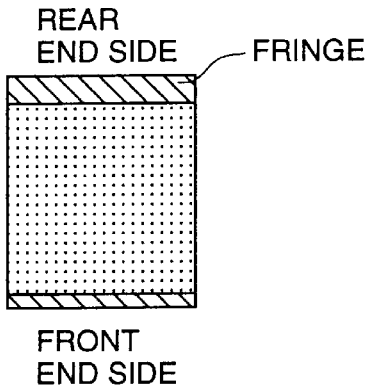

FIG. 10B is a view showing forces in the direction along the surface of the photosensitive body which act on the toner in the front end and the rear end of the image relative to the rotating direction of the developing roller. The directional relationship between the friction force FR and the electric field force qEz is different between the front end and the rear end of the image. In the front end of the image, the friction force FR and the electric field force qEz act in the same direction, and the toner developing the fringe is scraped off from the edge portion of the image.

On the other hand, in the front end of the image, the friction force FR and the electric field force qEz act in directions opposite to each other, and the toner developing the fringe is retained at the edge portion of the image. FIG. 10C is a view showing fringes occurring at the front end and the rear end of the image, in respect to the rotating direction of the developing roller, which fringes are produced by the above-mentioned forces acting on the toner on the surface of the photosensitive body. A larger fringe development appears at the rear end of the image than at the front end.

If the intensity of the fringes is suppressed to a certain degree by the resistivity of the developing agent and the developing bias using the difference in the characteristics of fringe occurrence intensity between the front end and the rear end of the image, what remains is only a fringe at the rear end of the image, which has a stronger intensity.

In FIG. 9, the exposure control means 123 judges whether or not data (a pixel of interest) about to be exposed is data corresponding to a white portion and whether the data is data located at the rear end (an image portion of a color) of a charged electric potential portion (an image portion of another color) relative to the rotating direction of the developing roller or data at the rear end of a discharged electric potential portion.

The judgment on whether or not a pixel of interest in the white portion is at the rear end of an image can be performed merely by checking past data having the same number line memory, and can be performed by a simple circuit. If it is judged that the pixel of interest is at the rear end of a charged electric potential portion, the pixel of interest is exposed with a light intensity forming an electric potential between the charged electric potential and the intermediate electric potential. If it is judged that the pixel of interest is at the rear end of a discharged electric potential portion, the pixel of interest is exposed with a light intensity forming an electric potential between the discharged electric potential and the intermediate electric potential.

Therein, the range of the auxiliary exposure is set to 0.4 mm from the last end portion of the image.

As described above, according to the present invention, the auxiliary exposure position can be judged by a simple circuit because the auxiliary exposure is applied to only the rear end of an image, and accordingly the fringe control circuit can be made small in size.

Another embodiment of the present invention will be described below, referring to FIG. 11 to FIG. 14.

Figure 11:
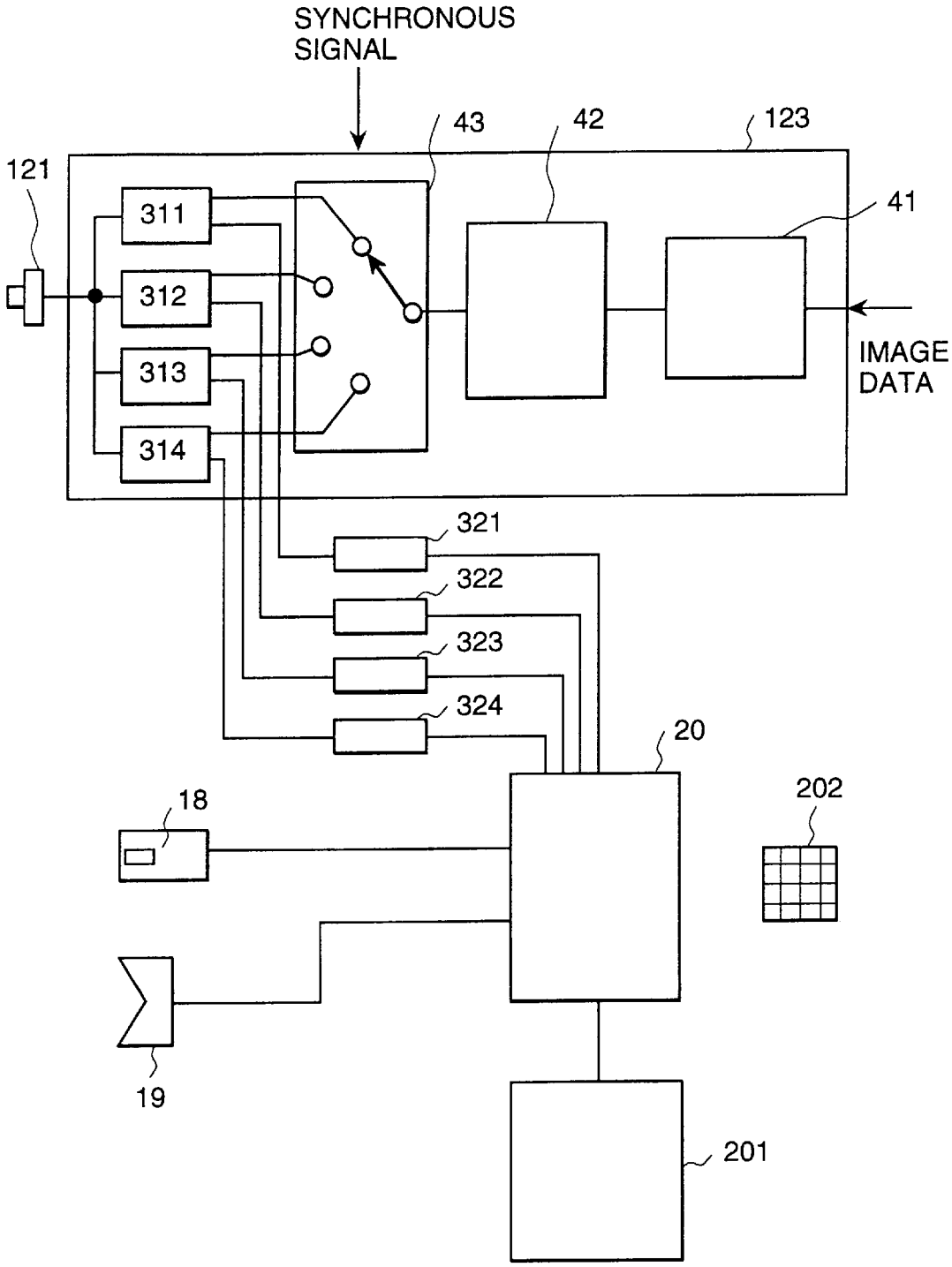
FIG. 11 is a schematic diagram showing the construction of an auxiliary exposure control unit.

FIG. 11 is a schematic diagram showing the construction of an auxiliary exposure control unit. A laser 121 has a drive circuit 311 for causing the laser to output a light intensity for forming a discharged electric potential portion, a drive circuit 312 for causing the laser to output a light intensity for forming an intermediate electric potential portion, a drive circuit 313 for causing the laser to output a light intensity for forming a correction electric potential portion 30 and a drive circuit 314 for causing the laser to output a light intensity for forming a correction electric potential portion 31, as seen in FIG. 4. Light intensity setting means 321, 322, 323, 324 are provided corresponding to the drive circuits 311, 312, 313, 314, respectively.

The total construction of the auxiliary exposure control portion of the electrophotographic apparatus in accordance with the present invention will be described below. The exposure control means 123 and the peripheral circuits are shown in FIG. 11. The main constitutional elements composing the exposure control means 123 are an image memory 41, a judging circuit 42 and a light intensity switching circuit 43. The judging circuit 42 judges from data of the image memory, which is the portion about to be exposed, a charged electric potential portion, or a portion at the rear end of a charged electric potential portion, relative to the rotating direction of the developing roller, or a discharged portion, or a portion at the rear end of a discharged electric potential portion, relative to the rotating direction of the developing roller, or a white portion spaced from both a charged electric potential portion and a discharged electric potential portion.

Then, based on the judged result, the photosensitive body is exposed by switching the light intensity using the light intensity switching circuit 43. Setting a value is carried out using a digital value, and as the initial set values, values stored in a memory means 201, such as a ROM, an IC card memory and the like, are used. Changing in the set values can be performed using a data input means 202, such as a ten-key pad or the like, through a process control means 20.

The value set by a digital value is converted to an analog output by the light intensity setting means, and the output is used as a light intensity setting input of the drive circuit. An output light intensity can be adjusted using a current when a semiconductor laser is used as the laser 121. Therefore, by designing the light intensity setting means so as to output an analog output as a current output, the current output can be used as the laser drive current.

Figure 12:
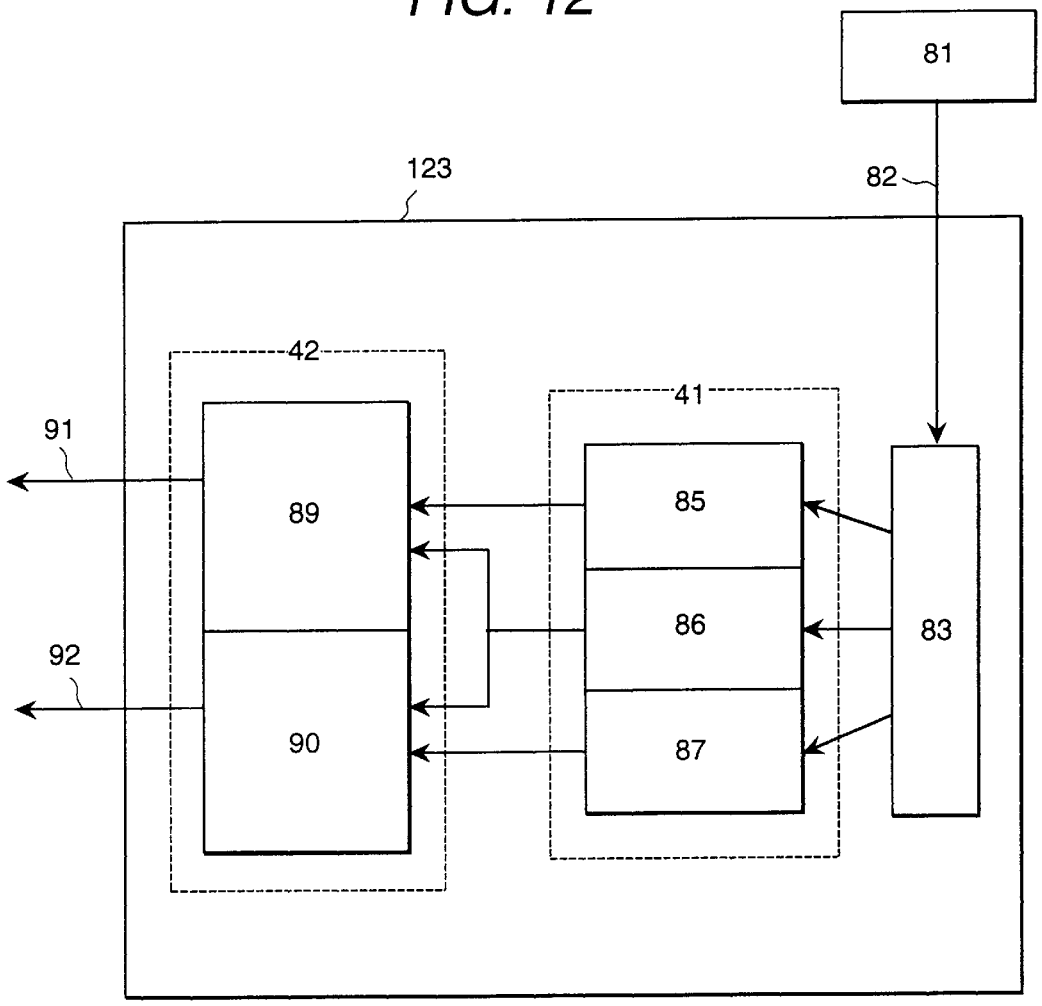
FIG. 12 is a block diagram showing the construction of portions of an image memory and a judging circuit in an exposure control means.
Figure 13:
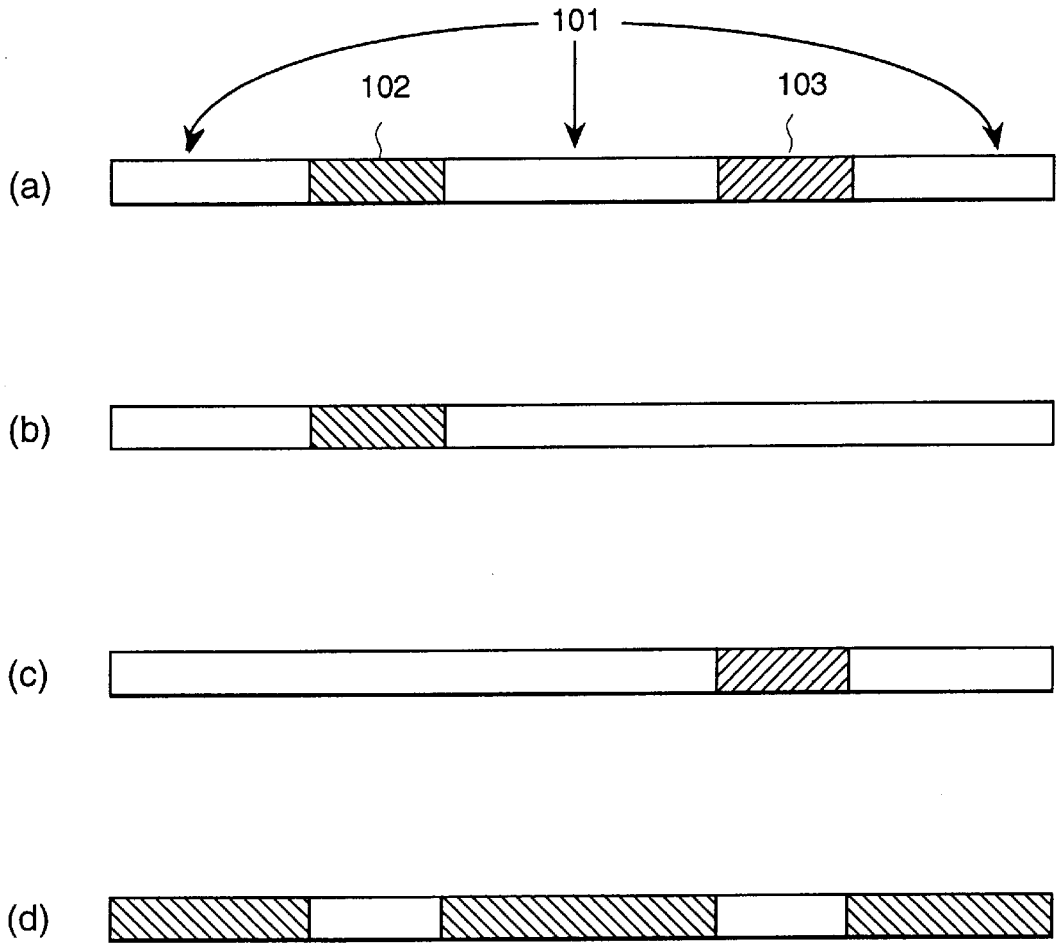
FIG. 13 is a diagram showing an example of the writing of image data into the image memory.
Figure 14:
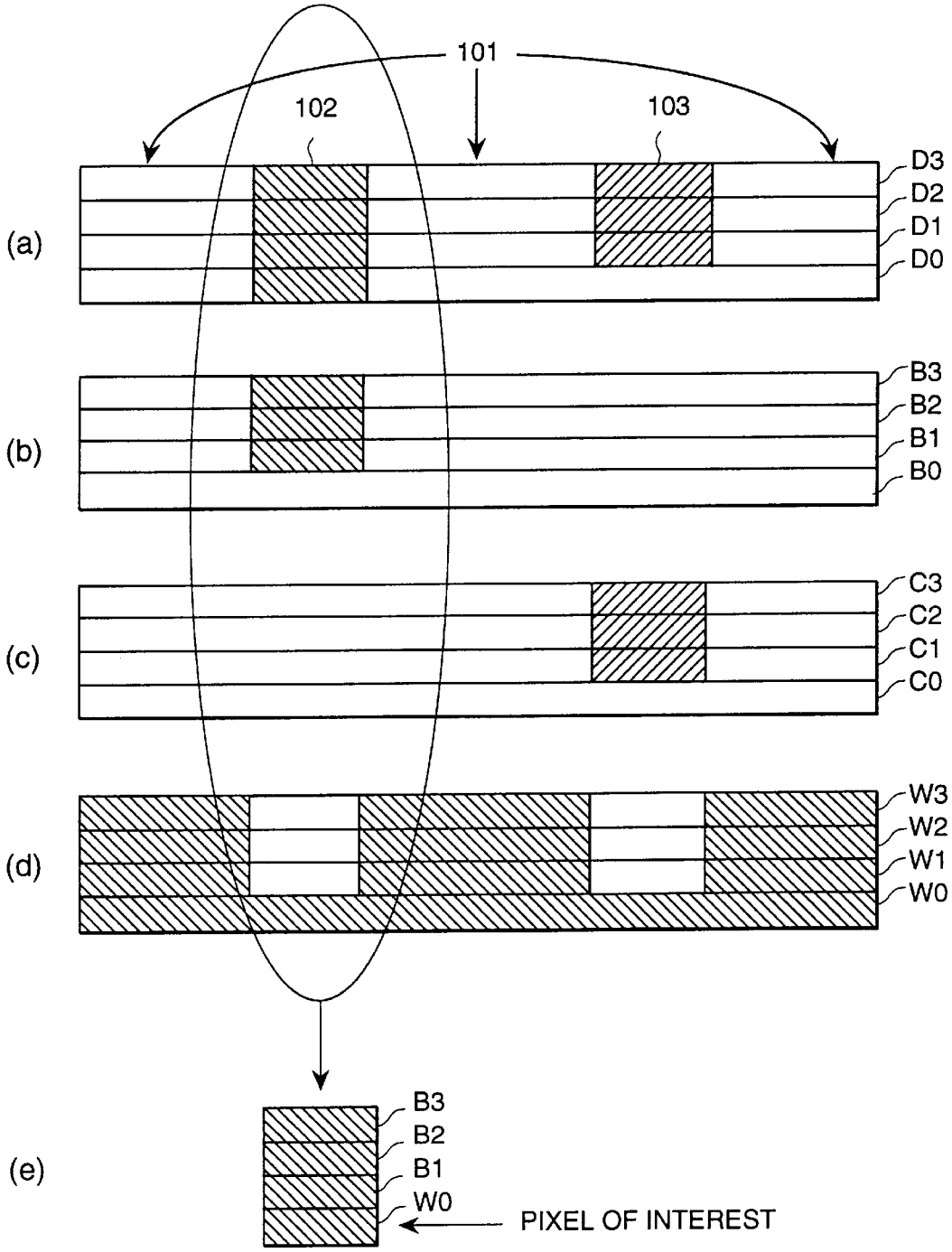
FIG. 14 is a diagram showing the operation of the judging circuit.

Operation of the exposure control means 123 will be described below in detail, referring to FIG. 12, FIG. 13 and FIG. 14. FIG. 12 is a block diagram showing the construction of the portions of the image memory 41 and the judging circuit 42 in the exposure control means 123. FIG. 13 shows an example of the writing of image data into the image memory 41. FIG. 14 is a diagram showing the operation of the judging circuit 42. In FIG. 12, a host computer 81 applies a ternary image signal 82 to an image signal judging circuit 83, which provides outputs to an image data storing area 85 for discharged electric potential portions, a storing area 86 for white image data and an image data storing area 87 for discharged electric potential portions. The exposure control means 123 further includes a judging portion 89 for the auxiliary exposure at the rear end of a discharged electric potential portion, relative to the rotating direction of the developing roller (hereinafter, referred to as a Vbf auxiliary exposure judging portion), and a judging portion 90 for the auxiliary exposure at the rear end of a charged electric potential portion, relative to the rotating direction of the developing roller (hereinafter, referred to as a Vcf auxiliary exposure judging portion). A signal 91 forming a correction electric potential Vbf is output by the judging portion 89, and a signal 92 forming a correction electric potential Vcf is output by the judging portion 90.

The image signal judging circuit 83 discriminates whether the ternary image signal 82 is an image signal of a discharged electric potential portion an image signal of a charged electric potential portion or a white portion image signal transmitted from the host computer 81 and, in response to such judgement, outputs one of an image signal of a discharged electric potential portion, an image signal of a charged electric potential portion and a white portion image signal.

Then, the data is classified into image data for a discharged electric potential portion, white portion image data and image data for a charged electric potential portion, and the data is stored in the image data storing area for discharged electric potential portion 85, the white image data storing area 86 and the image data storing area for charged electric potential portion 87 for each single line (one raster) relative to the laser scanning direction.

The Vbf auxiliary exposure judging portion 89 in the auxiliary exposure judging circuit 42 judges whether or not auxiliary exposure is to be performed on a pixel of interest using the image data for a discharged electric potential portion and the white portion image data stored in the image memory 41. If auxiliary exposure is necessary, a signal 91 forming a correction electric potential Vbf is output to the light switching circuit 43 in the following stage. Similarly, the Vcf auxiliary exposure judging portion 60 judges whether or not auxiliary exposure is to be performed on a pixel of interest using the image data for a charged electric potential portion and the white portion image data. If the auxiliary exposure is necessary, a signal 92 forming a correction electric potential Vcf is output to the light switching circuit 43 in the following stage.

FIG. 13 shows an example of the writing of image data into the image memory. In FIG. 13, the reference character 101 denotes white image data, the reference character 102 denotes image data for a discharged electric potential portion and the reference character 103 denotes image data for a charged electric potential portion. In the case of printing an image shown by line (a) in one raster, the ternary image signal 81 from the host computer 81 is transmitted in the manner shown by lines (b) and (c).

The image signal judging circuit 122 recognizes the data of lines (b) and (c). If neither of the image data for a discharged electric potential portion nor the image data for a charged electric potential portion is input, the image signal judging circuit 122 forms the data of line (d) as white image data. Then, the data of line (b), the data of line (c) and the data of line (d) are stored in the data storing areas in the image memory for each raster, respectively.

FIG. 14 is a diagram showing the operation of the judging circuit 42. The reference character 101 denotes white image data, the reference character 102 denotes image data for a discharged electric potential portion and the reference character 103 denotes image data for a charged electric potential portion. As an example of auxiliary exposure judgment, a description will be made below in a case of printing an image shown in FIG. 14 at line (a). Each of the reference characters D0, D1, D2, D3 indicate image data for a respective raster.

The data D0 is image data about to be printed now, the data D1 is past data by one raster relative to the data D0, the data D2 is past data by two rasters relative to the data D0, and the data D3 is past data by three raster relative to the data D0. In order to judge a pixel to be subjected to auxiliary exposure in the rear end of an image, relative to the rotating direction of the developing roller, a pixel of interest is compared with the past data. Assuming that the data D0 is the pixel of interest, the past data is D1, D2, D3.

Therein, since two kinds of image data, that is, image data for a discharged electric potential portion and image data for a charged electric potential portion, are mixed in the image data shown by line (a), the judging logic becomes complex if the pixel to be subjected to auxiliary exposure is judged simply by comparing it with the previous image data. As shown in FIG. 14, when the image data is stored in the storing areas of the image memory by classifying it into image data for a discharged electric potential portion, image data for a charged electric potential portion and white portion image data, the image data of line (a) is stored in the memory in the manner shown in lines (b), (c), (d).

Whether or not auxiliary exposure is to be performed on the pixel of interest can be judged by respectively comparing the two data storing areas, that is, the image data for a discharged electric potential portion and the white image data, or the image data for a charged electric potential portion and the white image data. Accordingly, the logic required for judging whether a pixel is to be subjected to auxiliary exposure becomes simple. FIG. 14 at line (e) shows an example of the image of a discharged electric potential portion. There are image data B1, B2, B3 for a discharged electric potential portion in the past image data relative to the white portion W0 about to be printed now.

A pixel to be subjected to auxiliary exposure is a white portion at the rear end of an image. Therefore, when a condition W0, B1, B2, B3 is produced, the pixel of interest W0 fits the condition for performing auxiliary exposure. At that time, a signal 91 for forming a correction electric potential Vbf is output from the Vbf auxiliary exposure judging portion 89. Similarly, a signal 92 for forming a correction electric potential Vcf is output from the Vcf auxiliary exposure judging portion 90.

According to the embodiment described above, the auxiliary exposure can be certainly performed by identifying the rear end of an image relative to the rotating direction of the developing roller, and thereby the problem of fringe development is solved, and an image without erroneous printing can be obtained.

Further, since judgment onto whether or not auxiliary exposure is to be performed on a pixel of interest can be performed by respectively comparing the two data storing areas, that is, the image data and the white image data, there is an effect that the logic of judging a pixel to be subjected to auxiliary exposure becomes simpler compared to that of the exposure control means which performs auxiliary exposure for all of the surrounding areas of an image, and that the circuit construction becomes simple and small-sized.

Figure 15:
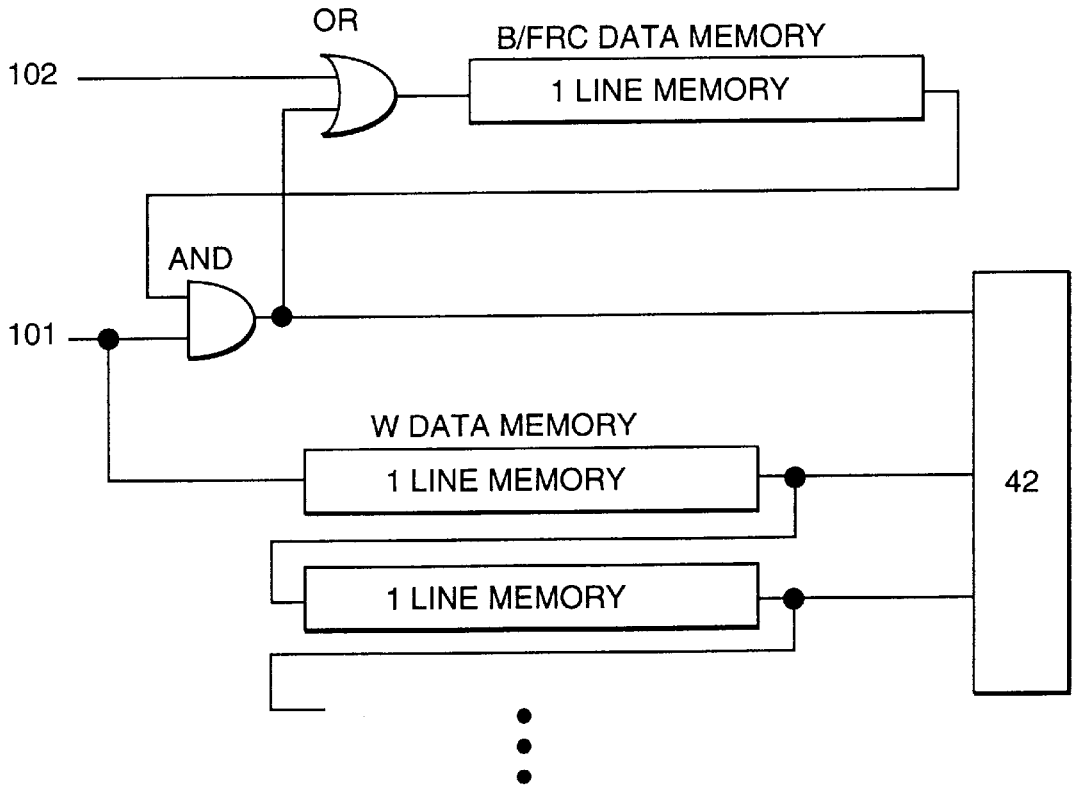
FIG. 15 is a schematic diagram showing the construction of another embodiment of an exposure control means 123 in accordance with the present invention.

A still further embodiment of the present invention will be described below, referring to FIG. 15. FIG. 15 is a relative diagram showing the construction of this embodiment of an exposure control means 123 in accordance with the present invention. The reference character 101 denotes white image data, the reference character 102 denotes image data for a discharged electric potential portion and the reference character 42 denotes an auxiliary exposure judging circuit.

B/FRC DATA MEMORY designates a line memory for storing image data for a discharged electric potential portion and auxiliary exposure data. W DATA MEMORY designates a line memory for storing white image data. The auxiliary exposure judging circuit 42 is a logic circuit for judging whether or not an auxiliary exposure is to be performed based on an image condition.

Judgment on an auxiliary exposure position of a white portion at the rear end of an image, relative to the rotating direction of the developing roller, can be performed if there is classification information, that is, information as to which data is past data by one line relative to a pixel of interest, image data for a discharged electric potential portion, or image data for a charged electric potential portion, or data subjected to auxiliary exposure.

An example of the exposure control means 123, including a memory for storing only the classification information necessary to make a judgment as to the need for auxiliary exposure, is shown in FIG. 15. The B/FRC DATA MEMORY contains data as to a logical sum of image data for a discharged electric potential portion being printed now and data subjected to auxiliary exposure. The W DATA MEMORY stores data as to the length of white pixels from the last rear end portion of an image. The auxiliary exposure judging circuit 42 judges that auxiliary exposure is to be performed if image data for a discharged electric potential portion exited in the past and the pixel of interest now is white image data.

Further, in a case where auxiliary exposure was performed in the past and the pixel of interest now is white image data, if the pixel now is within a preset auxiliary exposure range from the last rear end portion of an image, the auxiliary exposure judging circuit 42 judges that auxiliary exposure is to be performed. FIG. 15 shows the construction of the control circuit for suppressing fringe produced at the rear end of an image of a discharged electric potential portion relative to the rotating direction of the developing roller. However, the problem of fringe produced at the rear end of an image of a charged electric potential portion can be solved by using a similar construction.

According to the embodiment described above, the auxiliary exposure can be certainly performed by identifying the rear end of an image, relative to the rotating direction of the developing roller, and thereby the fringe development problem is solved, and an image without erroneous printing can be obtained. Further, since the exposure control means 123 comprises a memory for storing only the classification information on past data by one line relative to a pixel of interest, the image memory size can be reduced compared to the exposure control means described in the aforementioned embodiment, and the construction of the circuit can be made simpler and smaller in size.

As described above, according to the present invention, since using fringe control of the light intensity of the auxiliary exposure is set so that the reverse electric fields causing the primary fringe and the fringe caused by auxiliary exposure become nearly equal to each other, there is an effect in that not only the occurrence of the primary fringe can be prevented, but also the occurrence of the fringe caused by auxiliary exposure can be prevented.

Further, since the electric resistivity of the developing agent is set to a value below 469E+6 Ωcm, there is an effect in that the occurrence of the primary fringe and the fringe caused by auxiliary exposure can be prevented using fringe control and a sufficient image density can be obtained.

Furthermore, since curtailed exposure is performed in the terminal end portion of the auxiliary exposure range, there is an effect in that the peak value of the reverse electric field can be lowered and the light intensity of the auxiliary exposure can be increased, and that the absolute value of Vcc eliminating both the primary fringe and the fringe caused by auxiliary exposure can be further lowered.

Still further, since the electric potential of the intermediate electric potential zone is brought close to the bias electric potential of one image not subjected to auxiliary exposure and is moved away from a bias electric potential of the other image, it is possible to provide an auxiliary exposing method, and a small-sized circuit auxiliary exposing unit using the auxiliary exposing method, which can eliminate both the fringe around a red image and the fringe around a black image and the fringe caused by auxiliary exposure of the image subjected to auxiliary exposure only by applying auxiliary exposure to either of the images.

Since using fringe control on a white portion to produce a reverse electric potential therein in the rear end of an electric potential portion to be developed with toner, relative to a rotating direction of a developing roller is performed with the auxiliary exposure and white portions in the front end and the sides are exposed with a light intensity forming an intermediate electric potential, the identification of an auxiliary exposure position becomes simple and the fringe control circuit becomes small in size as a result.

Further, since the fringe control circuit comprises a memory for storing only the classification information on past data by one line relative to image data about to be printed now, the image memory can be reduced in size compared to the exposure control means described in the aforementioned embodiment and the construction of the circuit can be made simpler and smaller in size.

What is claimed is:

1. An electrophotographic printing apparatus comprising an electrophotographic printing apparatus using electric potential dividing development processing which forms zones having at least three different electric potential levels composed of a charged zone, an intermediate zone and a discharged zone on a photosensitive body using an exposing unit, and develops said charged zone and said discharged zone with different kinds of particles, respectively, and includes a fringe control means, wherein a light intensity of an auxiliary exposure is set so that the degrees of a primary fringe and a fringe caused by auxiliary exposure become nearly equal to each other when the primary fringe and the fringe caused by auxiliary exposure are generated and are controlled by adjusting a developing bias.

2. An electrophotographic printing apparatus according to claim 1, wherein the auxiliary exposure is applied to a zone adjacent to one electric potential zone of a charged zone, and a discharged zone and the auxiliary exposure is not applied to a zone adjacent to an other electric potential zone.

3. An electrophotographic printing apparatus according to claim 1, wherein the auxiliary exposure is applied to a zone adjacent to an electric potential zone, said electric potential zone having a smaller value between two values, one of said two values being a difference between a developing bias electric potential of a developing unit for developing said one electric potential zone of said charged zone and said discharged zone and the electric potential of said intermediate zone, and the other of said two values being a difference between a developing bias electric potential of a developing unit for developing an other electric potential zone and the electric potential of said intermediate zone.

4. An electrophotographic printing apparatus comprising an electrophotographic printing apparatus using electric potential dividing development processing including at least a photosensitive body; a first charging unit; an exposing unit; a developing unit; and a transfer unit, forming zones having at least three different electric potential levels on said photosensitive body using said exposing unit, said developing zones having at least two electric potential levels out of said zones having at least three different electric potential levels with different kinds of particles, respectively, which comprises:

fringe control means for preventing fringe development using auxiliary exposure, the auxiliary exposure being controlled so as to be switched on and off within a preset range in an end portion of an auxiliary exposure range.

5. An electrophotographic printing apparatus comprising an electrophotographic printing apparatus using electric potential dividing development processing which forms zones having at least three different electric potential levels composed of a charged zone, an intermediate zone and a discharged zone on a photosensitive body using an exposing unit, and develops said charged zone and said discharged zone with different kinds of colored particles, respectively, and includes a fringe control means, which comprises means for exposing an amount of light on a white portion, said white portion being located at a position at a rear end of an electric potential portion to be developed as a solid image with toner thereon, relative to a rotating direction of a developing roller, said amount of light forming an electric potential between the electric potential developing the solid image with toner and an intermediate electric potential, said means for exposing an amount of light on a white portion including a white portion deciding device having a recorder and a comparator, said recorder being operable to determine by computation a logical sum of an image signal for correcting a fringe and storing a result in a memory, said comparator comparing an image signal as read out of said memory with a white-level signal at a present line.

6. An electrophotographic printing apparatus according to claim 5, which further comprises:

means for judging a zone of a white portion located at a position at a rear end of a portion charged to an electric potential, relative to the rotating direction of the developing roller; and means for exposing an amount of light on the white portion, said amount of light charging the white portion to an electric potential between the electric potential of the charged portion and the intermediate electric potential.

* * * * *